United States Patent [19]

Pischinger et al.

[11] Patent Number: 4,730,454

[45] Date of Patent: Mar. 15, 1988

[54] PROCESS AND SYSTEM FOR THE OXIDATION OF ENGINE EMISSION PARTICULATES DEPOSITED IN A PARTICULATE FILTER TRAP

[75] Inventors: Franz Pischinger, Aachen; Gerhard Lepperhoff, Eschweiler, both of Fed. Rep. of Germany

[73] Assignee: FEV Forschungsgesellschaft für Energie-Technik und Verbrennungsmotoren mbH, Aachen, Fed. Rep. of Germany

[21] Appl. No.: 923,645

[22] Filed: Oct. 27, 1986

[30] Foreign Application Priority Data

Oct. 26, 1985 [DE] Fed. Rep. of Germany ..... 3538155

[51] Int. Cl.[4] ..... F01N 3/02

[52] U.S. Cl. ..... 60/274; 55/96; 55/302; 55/466; 55/DIG. 30; 60/303; 60/311

[58] Field of Search ..... 60/274, 286, 289, 303, 60/311; 55/96, 302, 466, DIG. 30

[56] References Cited

U.S. PATENT DOCUMENTS 3,930,803 1/1976 Winter ..... 55/466
4,398,931 8/1983 Shevlin ..... 55/302
4,404,795 9/1983 Oishi ..... 55/DIG. 30
4,641,496 2/1987 Wade ..... 55/DIG. 30

FOREIGN PATENT DOCUMENTS 2097283 11/1982 United Kingdom ..... 60/311

OTHER PUBLICATIONS

S.A.E. Paper 1985/850014, "Advanced Techniques for Thermal and Catalytic Diesel Particulates Trap Regeneration".

*Primary Examiner*—Douglas Hart
*Attorney, Agent, or Firm*—Watson, Cole, Grindle & Watson

[57] ABSTRACT

A process for the oxidation of a concentration of internal combustion engine emission particulates collected in a particulate filter trap by supplying secondary energy to the deposit at the inlet surface of the filter and/or to the particulate/exhaust gas mixture, includes adjusting the particulate concentration to a value which lies within the explosive range of the particulate/exhaust gas mixture by briefly adding, or recycling, combustible particulates to the exhaust gas flow in the filter, especially in front of the inlet face of the filter.

24 Claims, 12 Drawing Figures

PROCESS AND SYSTEM FOR THE OXIDATION OF ENGINE EMISSION PARTICULATES DEPOSITED IN A PARTICULATE FILTER TRAP

BACKGROUND OF THE INVENTION

This invention relates generally to a process and system for the oxidation of engine emission prticulates deposited in a particulate filter trap, by supplying secondary energy.

Systems have been developed for the treatment of diesel engine exhaust gas to reduce particle emission to render the exhaust gas as free of harmful substances as possible. Such systems primarily employ trap filters which trap and collect the particulates as the exhaust gas flows therethrough. However, the particulates deposited in the filter may produce increased flow resistance in the exhaust system which thereby increases the engine's back pressure. And, an increased concentration of particulates may, as a function of load and rpm, cause the engine to stall. It therefore becomes necessary to remove the particulates deposited in the filter continuously or intermittently, which is generally carried out by oxidation of the deposit of particulates.

Reliable filter systems for trapping the particulates with continuous or intermittent particulate combustion are, for example, in the form ceramic filters with a honeycomb structure, steel wool filters and ceramic foam filters with or without catalytic coating.

Various approaches have been taken in regenerating the particulate filters in which the collected particulates are intermittently burned to thereby lower the particulate emission of diesel engines. For example, in order to achieve regeneration of particulate filters, it was necessary to increase the exhaust gas temperature to such an extent that the deposited particulates were ignited and oxidized. However, this combustion required a great deal of energy.

A self-contained particulate oxidation is based on the knowledge that heat released during exothermic reactions is at equilibrium with the heat removed by the exhaust gas. If the removal of heat exceeds the released exothermic heat, the rate of oxidation falls below the rate at which particulates are deposited in the filter. This causes the particulate mass in the filter to rise. If, on the other hand, the rate of oxidation is larger than the heat removed, more particles are oxidized than the engine can move into the filter which thereby causes the particulate mass to decrease.

Steps have been taken in known systems to reduce heat removal by the expedient of increasing the exhaust gas temperature by operation of the engine or from a secondary energy source to such an extent that the reaction rate is significantly increased and the heat removal drops because of higher exhaust gas temperature.

To achieve the filter regeneration which is independent and is energy efficient and utilizes the exothermic energy of particulate oxidation, it is possible to reduce heat removal or to attempt to increase the reaction rate.

An S.A.E. Paper 1985/850014, entitled "Advanced Techniques for Thermal and Catalytic Diesel Particulate Trap Regeneration", discloses a technique for regenerating diesel particulate traps employing secondary heat energy by the provision of an electric resistance heater, and an additional air supply.

SUMMARY OF THE INVENTION

It is therefore an object of the present invention to provide an improved process and system for regenerating diesel particulate traps employing a supply of secondary energy in a simple and economical yet highly effective manner.

The invention is premised on the significant recognition that in the field of internal combustion engine technology the concentration of particulates or soot in exhaust gas is clearly below the concentration required to obtain an explosive mixture. The particulates deposited on the walls of the filter channels and their concentration thereof are clearly above the explosive range. The explosive range has been calculated to be 200 g/m$^3$ by coal dust explosion tests for the mining industry. The stoichiometric ratio is 130 g carbon/m$^3$.

In a process and system for oxidation of particulates deposited in a filter trap by supplying a secondary energy, the present invention provides for an adjustment of particulate concentration to a value which lies within the explosive range of the particulate/exhaust gas mixture by briefly adding or recycling combustible particulates to the exhaust gas flow in the filter especially in front of the entry surface of the filter trap.

Generally, according to the invention, the particulate concentration at the point of ignition is increased by agitating the collected particles. Otherwise, finely dispersed carbon particles may be introduced from a reservoir to increase particle concentration in the filter especially in front of the entry surface of the filter.

The regeneration problem when applying the invention is solved by adjusting the carbon/air or carbon/exhaust gas concentration in such a manner that, locally, it lies within the explosive range for all rpm and load ranges. This is accomplished in such a manner that at higher loads and rpms the concentration of particulates or soot in the exhaust gas is increased by intermittent addition of such substances as coal or coke dust, or that the deposited particulates on the filter trap is agitated. As the result of this agitation or addition an explosive particulate/air mixture is created at the location at which the secondary heat energy is supplied which thereby ignites. The exothermic heat thereby released is higher than the heat removed, so that an explosive wave runs through the filter and areas are ignited and burn which are spaced away from the point of ignition.

DETAILED DESCRIPTION OF THE INVENTION

Figure 1:
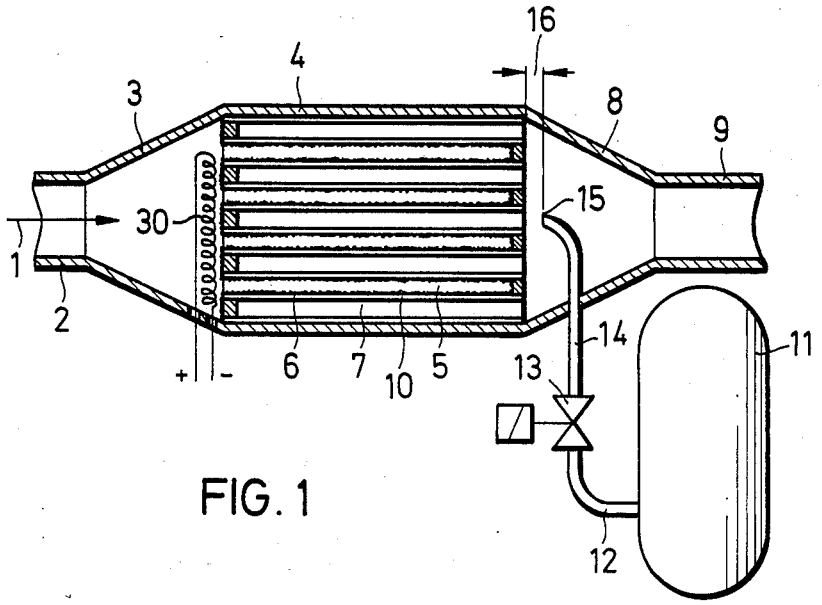
FIGS. 1 to 6 schematically illustrate particulate filter trap arrangements in longitudinal section for the oxidation of internal combustion engine emission particulates according to the invention.

Turning now to the drawings wherein like reference characters refer to like and corresponding parts throughout the several views, a filter trap of known construction is illustrated in FIG. 1 which is typically coupled to the exhaust pipe (not shown) of an internal combustion engine so that exhaust gas to be purified flows therethrough in the direction of arrow 1 via a pipe connection through and into a conical transition chamber 3 and from there into a cylindrical chamber 4 which contains the filter material. Such filter material may be a ceramic filter with a honeycomb structure designed in such a manner that the exhaust gas be purified flows into depository channels 5 and reaches channels 7, while depositing the greatest amount of soot and other particulates on ceramic walls 6, and is subsequently removed as purified gas via a conical transition chamber 8 and a pipe connection 9.

The concentration of soot and other particulates deposited form a layer 10 on ceramic walls 6, and secondary heat energy is supplied from an electric resistance heater 30 located in front of the entry surface of the filter trap.

In accordance with the invention, to adjust the particulate concentration to a value which lies within the explosive range of the particulate/exhaust gas mixture by briefly recycling combustible particulates to the exhaust flow in front of the filter, the particulate concentration at the point of ignition is increased through agitation of deposited particulates which, in FIG. 1, is carried out by a brief pulse-type blast return of a quantity of the purified exhaust gas flow by means of compressed or pressurized air.

To accomplish this a pressurized container 11 is provided which is fed by a source (not shown) of compressed air. The pressurized container 11 is connected via a conduit 12 and a suitable control device 13, for example a magnetic valve, to a conduit 14 having a nozzle 15 at its free end through which pressurized air is blown onto the exit surface of the filter. And because of the injector effect, purified exhaust gas is likewise blown onto the exit surface. Nozzle 15 is spaced from the exit surface a distance 16 of no greater than about 15 mm. And, the same distance can also be maintained when blowing onto the entry surface of the filter.

Figure 2:
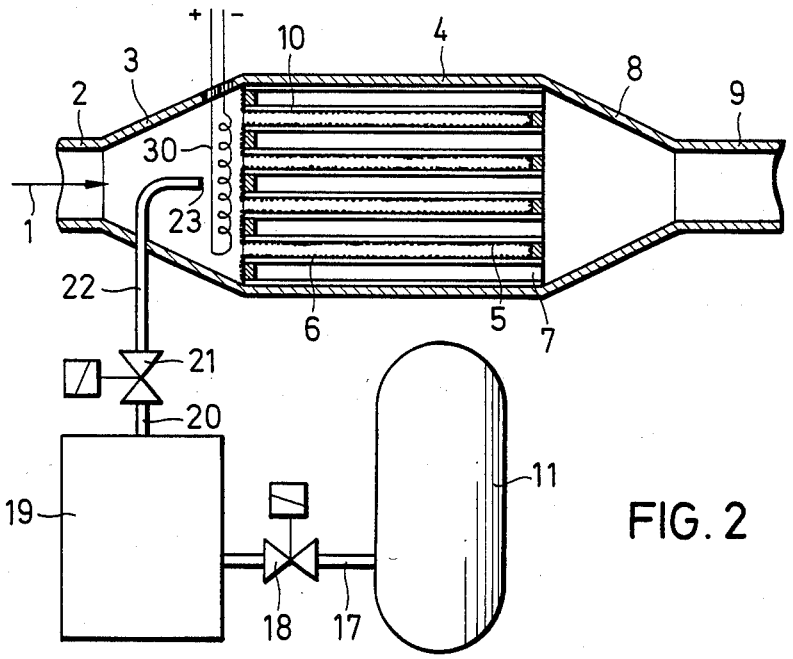

In the FIG. 2 arrangement, compressed air container 11 is connected via a conduit 17 and a suitable control device 18, for example a magnetic valve, with a particulate reservoir 19. In order to adjust the particulate concentration to a value that lies within the explosive range of the particulate/exhaust gas mixture by adding combustible particulates to the exhaust flow in front of the filter, combustible particulates are introduced, finely dispersed, ahead of the filter entry surface from particle reservoir 19, via a conduit 20, a suitable control device 21 such as a magnetic valve, and a conduit 22 and through its nozzle 23.

Figure 3:
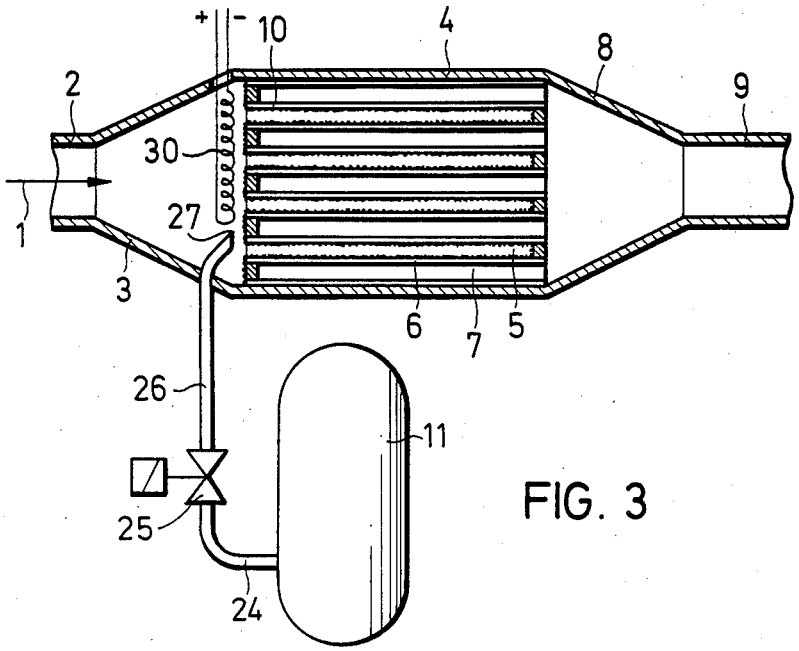

The FIG. 3 arrangement is similar to that of FIG. 1 except that compressed air is blown on onto the entry surface of the filter. Thus, compressed air container 11 is connected to a discharge nozzle 27 via a conduit 24, a control device 25 (such as a magnetic valve) and a conduit 26. In this arrangement, the particle concentration at the point of ignition is adjusted by brief pulsed blasts of air onto the entry surface of the filter.

Some of the exhaust gas to be purified will be included in the agitation of the collected particulates because of the injector effect of nozzle 27.

It is also possible to employ the exhaust gas to be purified exclusively, or with air in another suitable mixture, for agitating the carbon particulate deposits in the filter channels and/or the filter entry surface. The blowing onto or the return blast in such process is preferably of short duration and pulsed. Instead of compressed air, charged air can also be employed for this process according to the invention.

Figure 4:
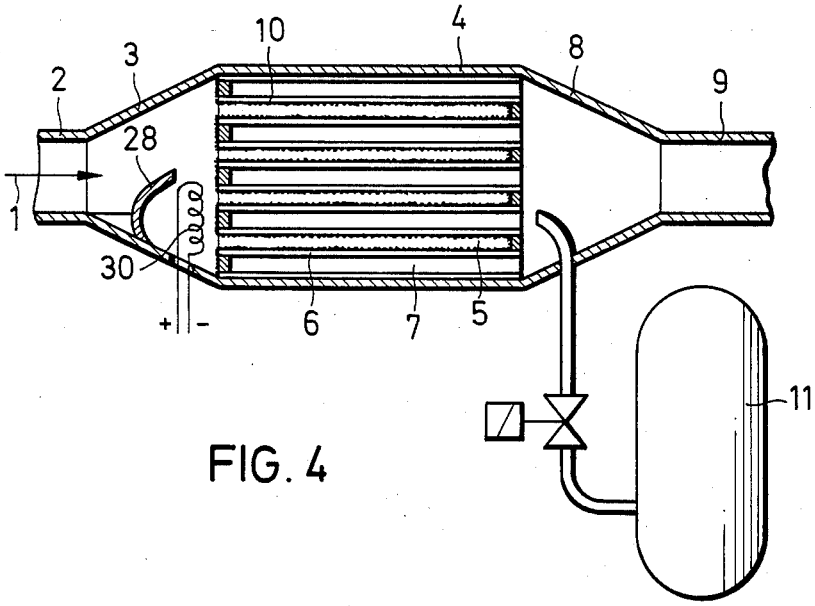

The FIG. 4 arrangement is basically the same as FIG. 1 except that an exhaust gas flow controller 28 is provided in front of the filter entry surface, the controller being in the form of a curved plate having its concave side facing the filter entry surface.

Controller 28 functions as a flame retention element and, as a result, the recirculation of the exhaust gas flow creates a zone characterized by slow flow movement, so that the speed at which the flame progresses can be faster than or equal to the speed of exhaust gas flow.

The ignition flame is consequently stablized in the area within controller 28. Also, the flow controller may be provided with a central opening for causing the flame to be diverted in the direction of the filter surface which improves its ignition.

Figure 5:
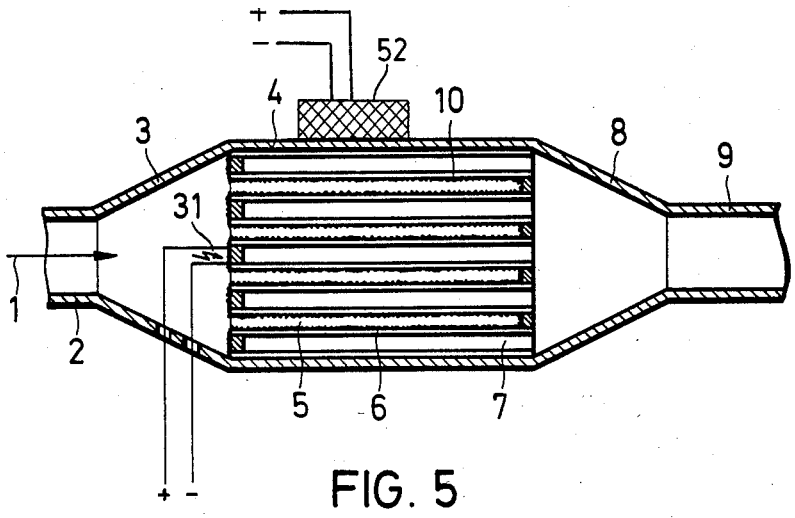

In FIG. 5, other means such as a spark gap 31 is shown for supplying secondary energy for any of the disclosed embodiments. The deposited particulate could be agitated by the provision of an oscillator for producing effecting high frequency oscillations.

Figure 6:
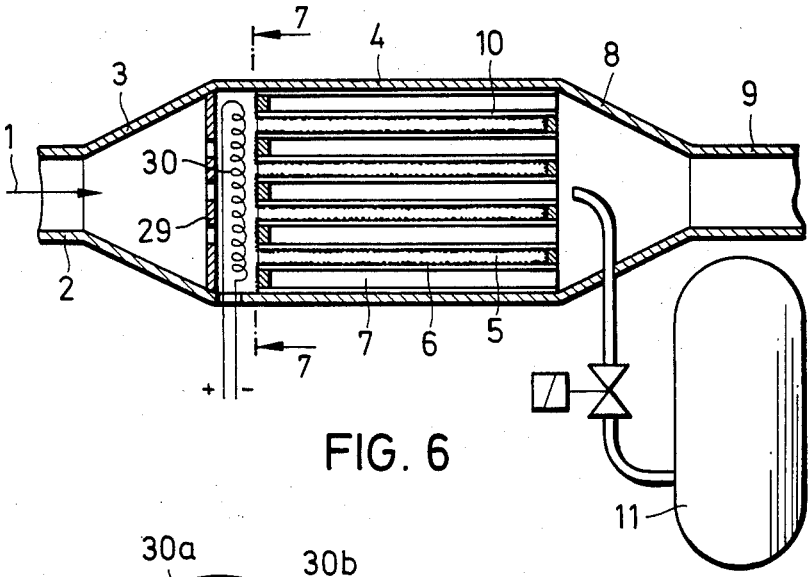

In FIG. 6, an exhaust gas flow controller 29 is in the form of a perforate plate extending transversely to the direction of exhaust flow 1.

Figure 7:
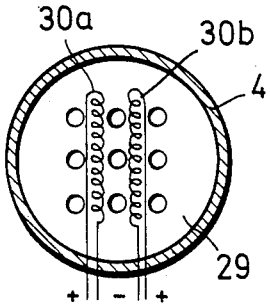
FIG. 7 is a sectional view taken substantially along the line A–B of FIG. 6.

In the aforedescribed arrangements, the secondary energy is supplied through a resistance heater 30 or through several of such heaters. For example, as shown in FIG. 7, two of such electric resistance heaters **30*a* and 30*b* are provided in the direction of exhaust gas flow behind perforate plate 29** in such a manner that they are located in the path of the flow.

Figure 8:
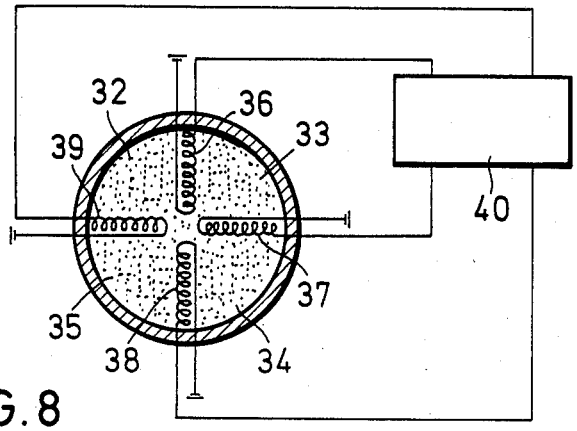
FIG. 8 is a view similar to FIG. 7 of another embodiment of the invention.

In the FIG. 8 arrangement, the secondary energy can be applied through electric resistance heaters or through one or more spark gaps into segmented filter areas 32, 33, 34 and 35 distributed over the filter entry surface. The secondary energy is supplied through electric resistance heaters 36, 37, 38 and 39. A control unit 40 with time controls provides uniform control of the segmental areas as a function of the prevailing operating conditions.

The segmental filter areas are appropriately supplied with energy in sequence. The duration of the supply of secondary energy, just as in the previously described arrangements, is brief in relation to the oxidation time of the particles deposited in the filter trap. The duration of the secondary energy supply may be about 30 seconds with a regeneration time of about two minutes. For example, the electric resistance heaters have to be energized for about 30 seconds to ignite the particulate/exhaust gas mixture in front of the trap. The following regeneration of the trap takes about two minutes.

Figure 9:
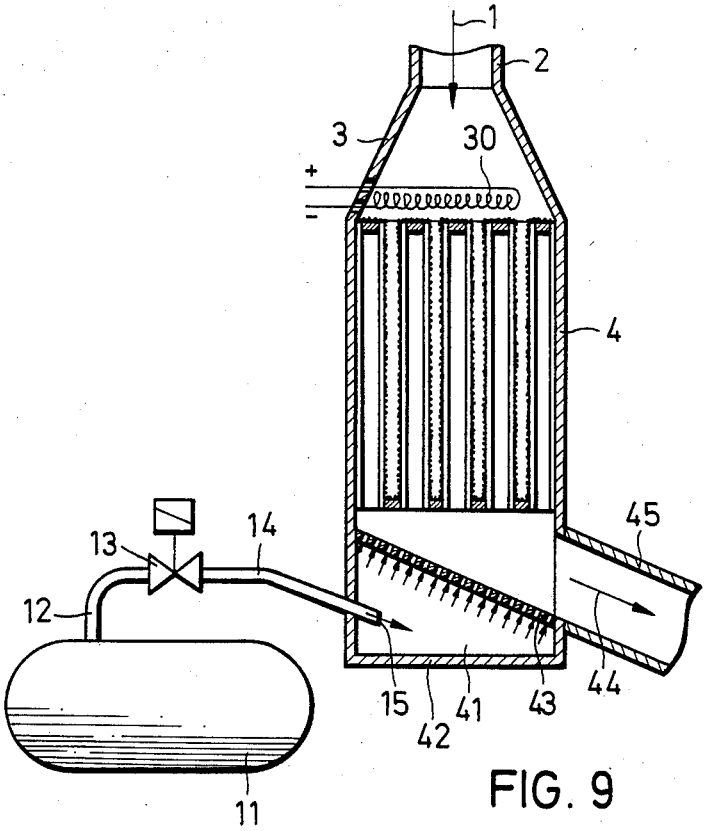
FIGS. 9 to 11 schematically illustrate further embodiments of particulate filter trap arrangements in longitudinal section for the oxidation of internal combustion emission particulates according to the invention.

Another arrangement according to the invention is shown in FIG. 9 which is similar to FIG. 1, except that downstream of filter chamber 4 is a cylindrical chamber 41 formed by an end wall 42 and a plate 43 which is adapted to the cross-section of chamber 41 to effect a basically uniform, area-covering blast of pressurized air in the direction of the filter exit surface (shown by the short arrows) for the purpose of agitating deposited particulates. Plate 43 may be in the form of a wire mesh, a perforate sheet metal plate, a porous body which allows gases to pass, or the like.

The compressed air is introduced into chamber 41 by container 11 via conduit 12, control device 13, conduit 14 and its nozzle 15. The removal of the purified gases takes place in the direction of arrow 44 through pipe connection 45.

Figure 10:
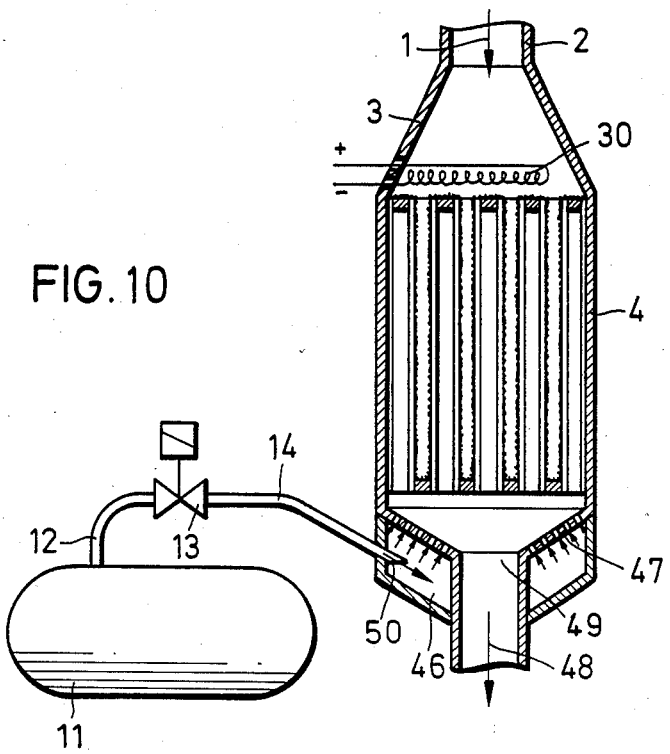

A further arrangement according to the invention is shown in FIG. 10 which is similar to the FIG. 1 arrangement in many respects such that like elements are identified by like reference numerals. At the downstream end of the filter chamber is a cylindrical chamber 46 formed by a conical end wall and a conical plate 47. Such plate may be in the form of a wire mesh, a perforate sheet metal plate, a body of porous material, or the like. The purified gas flows in the direction of arrow 48 through a central opening of plate 47. Compressed air is introduced into chamber 46 from container 11 via conduit 12, control device 13, conduit 14 and its nozzle 50. As in FIG. 9, pressurized air is blown onto the exit surface of the filter arrangement in the direction of the small arrows shown in FIG. 10 through plate 47. And, because of the injector effect produced by nozzle 50, purified exhaust gas is likewise blown onto the exit surface.

Figure 12:
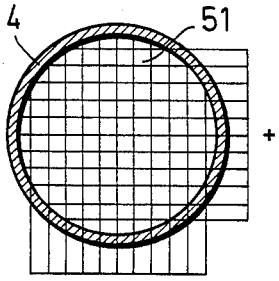
FIG. 12 is a cross-sectional view taken substantially along the line A–B of FIG. 11.
Figure 11:
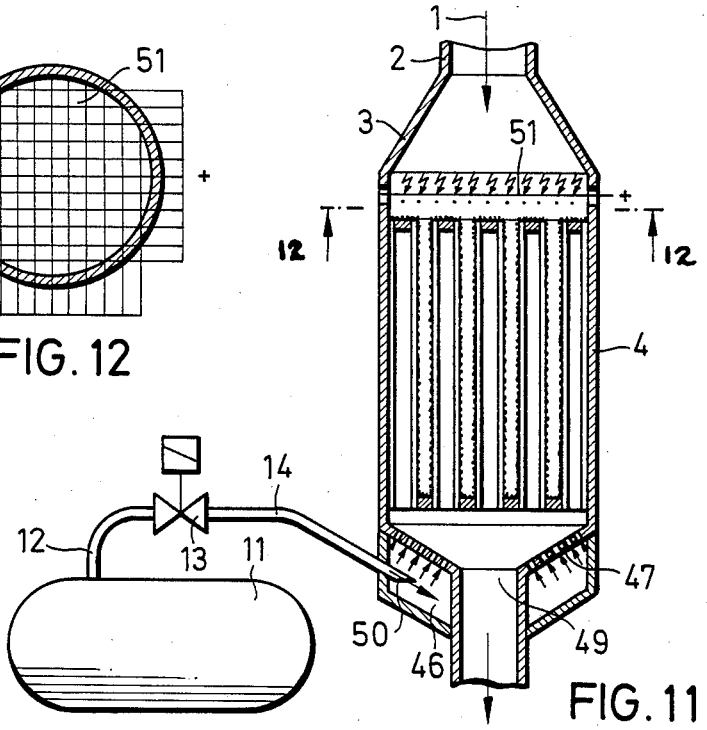

FIGS. 11 and 12 illustrate another arrangement according to the invention similar to that of FIG. 10 at the exit side of the filter. At the filter entrance surface, however, the secondary energy is not supplied through resistance heating as in FIGS. 9 and 10, but rather via a wire mesh 51 in which, after providing the desired voltage, ignition sparks jump over the intersections of the wires. This effects an even introduction of secondary energy dispersed over the entire filter entry surface.

From the foregoing, it can be seen that a reliable process has been developed for regenerating the filter trap by oxidation which can be carried out under any operational conditions, so that both excessive temperatures, which could damage the filter, the filter clogging, which could interfere with the operation of the engine, are avoided.

Obviously, many other modifications and variations of the invention are made possible in the light of the above teachings. It is therefore to be understood that within the scope of the apended claims the invention may be practiced otherwise than as specifically described.

What is claimed is:

1. A process for the oxidation of a concentration of internal combustion engine emission particulates collected in a particulate filter trap by supplying secondary energy to the deposit at an inlet surface of the filter and/or to the particulate/exhaust gas mixture, comprising the step of adjusting the concentration of particulates in one of: (a) in the filter; (b) in front of the inlet surface of the filter; and (c) in the filter and in front of the inlet surface of the filter, to a value that lies within the explosive range of the particulate/exhaust gas mixture, the adjusting step being carried out by one of: (aa) recycling combustible particulates; (bb) briefly introducing combustible particulates to the exhaust gas flow in front of the inlet face of the filter; and (cc) recycling combustible particulates and briefly introducing combustible particulates to the exhaust gas flow in front of the inlet face of the filter.

2. The process according to claim 1, wherein the particulate concentration at the point of ignition is increased by agitating the collected particulates.

3. The process according to claim 2, wherein the particulate concentration at the point of ignition is increased by producing a brief pulsed return blast of a quantity of exhaust gas to be purified for agitating the particulate deposit in the filter channels.

4. The process according to claim 2, wherein the particulate concentration at the point of ignition is increased by producing a brief pulsed return blast of compressed air.

5. The process according to claim 2, wherein the particulate concentration at the point of ignition is increased by producing a brief return blast of complete or partial supply of charged air.

6. The process according to claim 2, wherein the particulate concentration at the point of ignition is increased by producing a brief pulsed return blast of a portion of the purified exhaust gas flow.

7. The process according to claim 2, wherein the particulate concentration at the point of ignition is adjusted by producing one of: (a) a brief blast of air; (b) of exhaust gas; and (c) of a brief blast of air and of exhaust gas, onto the inlet surface of the filter.

8. The process according to claim 2, wherein the particulate concentration at the point of ignition is adjusted by producing one of: (a) a brief blast of air; (b) of exhaust gas; and (c) of a brief blast of air and of exhaust gas, onto an outlet surface of the filter.

9. The process according to claim 7, wherein one of the steps (a), (b) and (c) is carried out through a nozzle spaced from the inlet surface no greater than about 15 mm.

10. The process according to claim 8, wherein one of the steps (a), (b) and (c) is carried out through a nozzle spaced from the outlet surface no greater than about 15 mm.

11. The process according to claim 1, wherein the combustible particulates comprise finely distributed carbon particles introduced from a supply to increase the particulate concentration at the inlet surface of the filter.

12. The process according to claim 1, comprising the further step of stabilizing the ignition and combustion of the collected particulates effected by the supplying and adjusting steps by providing an exhaust gas flow controller in front of the inlet surface of the filter.

13. The process according to claim 1, wherein the supplying of the secondary energy is carried out by providing electric resistance wire means.

14. The process according to claim 1, wherein the supplying of the secondary energy is carried out by providing means for generating an electric spark gap.

15. The process according to claim 13, including the step of supplying the secondary energy to the segmented areas of the filter at the inlet surface.

16. The process according to claim 15, including the step of sequentially supplying the secondary energy to the segmented areas.

17. The process according to claim 1, wherein the oxidation takes place over a given duration of time, and the supplying of the secondary energy is carried out over a duration of time which is less than said given duration.

18. The process according to claim 17, wherein said given duration of time is about 2.0 minutes, and the duration of time during which the secondary energy is supplied is about 30 seconds.

19. A system for the oxidation of a concentration of internal combustion engine exhaust gas particulates collected in a particulate filter trap having an inlet surface facing the exhaust gas flow from the engine, comprising means for supplying secondary energy to the deposit at the inlet surface of the filter and/or to the particulate/exhaust gas mixture, and means for briefly introducing combustible particulates to the exhaust gas flow in the filter especially at the inlet surface of the filter for adjusting the concentration of particulates to a value that lies within the explosive range of the particulate/exhaust gas mixture.

20. The system according to claim 19, further comprising an exhaust gas flow controller in front of the inlet surface of the filter for creating a recirculation zone to stabilize ignition and combustion of the concentration.

21. The system according to claim 20, wherein said controller has a concave surface facing the inlet surface.

22. The system according to claim 20, wherein said controller comprises a perforate wall extending transversely of the filter trap.

23. The process according to claim 2, wherein the collected particulates are agitated by oscillation.

24. The process according to claim 23, wherein the collected particulates are agitated by high frequency oscillation.

* * * * *